US007887443B2

(12) United States Patent
Bryant

(10) Patent No.: US 7,887,443 B2
(45) Date of Patent: Feb. 15, 2011

(54) FRAME FOR MEASURING PITCHER'S CIRCLE

(76) Inventor: Earl M. Bryant, 1309 S. Madison St., Gillespie, IL (US) 62033

( * ) Notice: Subject to any disclaimer, the term of this patent is extended or adjusted under 35 U.S.C. 154(b) by 1297 days.

(21) Appl. No.: 11/085,278

(22) Filed: Mar. 21, 2005

(65) Prior Publication Data

US 2006/0211521 A1 Sep. 21, 2006

(51) Int. Cl.
*A63B 71/00* (2006.01)
*A63B 69/00* (2006.01)

(52) U.S. Cl. ..... 473/497; 473/422; 473/490

(58) Field of Classification Search ..... 473/490, 473/497, 499, 500, 451, 468; 33/755–759, 33/700, 574, 1 G, 27.01, 27.02
See application file for complete search history.

(56) References Cited

U.S. PATENT DOCUMENTS

| | | | | | |
|---|---|---|---|---|---|
| 962,702 | A | * | 6/1910 | Diracca | 33/27.03 |
| 1,572,237 | A | | 2/1926 | Hunt | |
| 2,602,233 | A | | 7/1952 | Irving | |
| 2,781,584 | A | * | 2/1957 | Cederholm | 33/759 |
| 3,668,781 | A | | 6/1972 | Teter | |
| 3,678,592 | A | | 7/1972 | Williamson | |
| 3,834,030 | A | * | 9/1974 | Hanson | 33/759 |
| 3,948,521 | A | | 4/1976 | Warren | |
| 4,160,324 | A | | 7/1979 | Dunn | |
| 4,162,789 | A | | 7/1979 | Hollaway | |
| 5,253,421 | A | * | 10/1993 | Landmark | 33/27.03 |
| 5,371,949 | A | | 12/1994 | Delaurier | |
| 5,427,383 | A | | 6/1995 | Viens | |
| 5,465,962 | A | * | 11/1995 | Hiserman | 273/118 R |
| 5,556,090 | A | * | 9/1996 | Coleman | 473/468 |
| 6,012,228 | A | * | 1/2000 | Fisanich | 33/289 |
| 6,430,819 | B1 | | 8/2002 | Aldstadt et al. | |
| 6,843,739 | B2 | * | 1/2005 | Putnam | 473/497 |
| 6,851,199 | B1 | * | 2/2005 | Zeitz | 33/289 |
| 2006/0010705 | A1 | * | 1/2006 | Dettellis | 33/756 |

* cited by examiner

*Primary Examiner*—Mitra Aryanpour
(74) *Attorney, Agent, or Firm*—Spencer, Fane, Britt & Browne, LLP

(57) ABSTRACT

A frame for measuring a pitcher's circle includes a housing for engagement with a pitcher's plate, a measuring line and a guide rod. The measuring line is swivel connected to a centering member on the housing, with its free end connected to the guide rod. The measuring line has a predetermined length such that the tip of the guide rod represents the radial distance of the pitcher's circle when the measuring line is fully extended from the centering member. The pitcher's circle is marked out by simply walking the guide rod about the pitcher's plate. A leveling member is provided on the guide rod to ensure that the guide rod is kept at 90° vertical to prevent measuring inaccuracies.

12 Claims, 4 Drawing Sheets

FRAME FOR MEASURING PITCHER'S CIRCLE

BACKGROUND OF THE INVENTION

This invention relates to sporting equipment used for softball, and, more particularly, equipment for measuring out a pitcher's circle.

Official rules for playing softball prescribe that the circle to be drawn designating the pitcher's circle be a certain dimension, namely 16 feet. The pitcher's circle plays an important part in the game in that runners may not advance while the ball is anywhere within the pitcher's circle. Accordingly, it is desirable that the pitcher's circle be accurately measured out and clearly outlined.

Many methods are used for drawing out the pitcher's circle, which can range from rough estimation to exact precision. Most methods, however, are likely to include the use of a measuring line comprising the approximate radial distance of the circle, where one end of the line is held or anchored at the proposed center point of the pitcher's circle, i.e., the pitcher's plate position. The free end of the measuring line is extended out to its full length, which represents the edge of the pitcher's circle to be drawn, and then the line is moved about in the direction of a circle about the pitcher's plate. The line representing the circle may be drawn out simultaneously, and can be either a chalk line or can be painted.

While this is a relatively simple operation, it can be subject to accuracy errors if the measuring line becomes unanchored from the center point. Also, if the measuring line does not freely swivel, it may instead wrap and bind around the anchoring point as the measuring line is moved around the circle, thus increasingly shortening the radial distance so that an imperfect circle is drawn. Occasionally, the pitcher's plate will already be in place when the pitcher's circle is measured out. The pitcher's plate is made from hard rubber or other rigid material, and does not permit a centering spike to be driven in to the ground through it. Accordingly, a center point can be difficult to establish and therefore difficult to accurately measure a circle from. Lastly, even if a precise center point is established and the measuring line can swivel freely around it, the manner in which the end of the measuring line is held may result in an inaccurately drawn circle. Oftentimes, the measuring line is attached to an elongated rod for the convenience of the person measuring out the circle so he can avoid bending over when walking out the circle. However, if the rod is not held at a 90° angle from the ground, the length of the chain can vary somewhat resulting in an uneven circle.

Accordingly, it is desirable to provide a system for measuring out a pitcher's circle on a softball diamond that is easy to use and can consistently and accurately measure out precise circles around a pitcher's plate.

BRIEF SUMMARY OF THE INVENTION

There is, therefore, provided in the practice of the invention a device for consistently and accurately measuring out precise circles around a pitcher's plate. A preferred embodiment of the invention comprises a housing for engagement to a pitcher's plate or "rubber", a measuring line and a guide rod. The pitcher's plate has a standard dimension, and the housing is provided with a dimension approximating, but slightly greater than, the pitcher's plate. The housing is placed over the pitcher's rubber and is held in place by engagement of the housing's side walls with the edges of the pitcher's rubber. The measuring line is swivel connected to the housing at the center of its top edge. A centering member is placed on the housing for providing the point of attachment of the swivel connection. The free distal end of the measuring line is adapted for connection to the guide rod. The length of the measuring line is such that bottom end of the guide rod represents the radial distance of the pitcher's circle when the measuring line is extended its full length from the connection point with the housing.

To measure and draw out the pitcher's circle, one merely extends the measuring line and guide rod out to their full distance from the connection with the housing. A leveling member is provided on the guide rod to ensure that it is held at a 90° angle from the ground. This prevents measurement inaccuracies that can be caused if the guide rod is tilted from the vertical. When the guide rod is tilted, it can effectively change the measured distance of the line as marked off by the tip end of the guide rod. The swivel connection of the measuring line to the housing permits the user holding the guide rod to simply walk out the circle. The tip end of the guide rod leaves a mark in the dirt which can then be lined by chalk or paint.

Accordingly, it is an object of the present invention to provide an improved device for consistently and accurately measuring out a circle around a pitcher's plate. There has thus been outlined, rather broadly, a preferred embodiment of the invention in order that the detailed description thereof herein may be better understood, and in order that the present contribution to the art may be better appreciated. There are, of course, additional embodiments of the invention that, while not disclosed here in detail, will be understood by those having ordinary skill in the art and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of embodiments in addition to those described and of being practiced and carried out in various ways. Also, it is to be understood that the phraseology and terminology employed herein, as well as the abstract, are for the purpose of description and should not be regarded as limiting.

As such, those skilled in the art will appreciate that the conception upon which this disclosure is based may readily be utilized as a basis for the designing of other structures, methods and systems for carrying out the several purposes of the present invention. It is important, therefore, that the claims be regarded as including such equivalent constructions insofar as they do not depart from the spirit and scope of the present invention. Though some features of the invention may be claimed in dependency, each feature has merit when used independently.

BRIEF DESCRIPTION OF THE DRAWINGS

Further features of the present invention will become apparent to those skilled in the art to which the present invention relates from reading the following description with reference to the accompanying drawings, in which.

DETAILED DESCRIPTION OF THE INVENTION

Figures 1, 2:
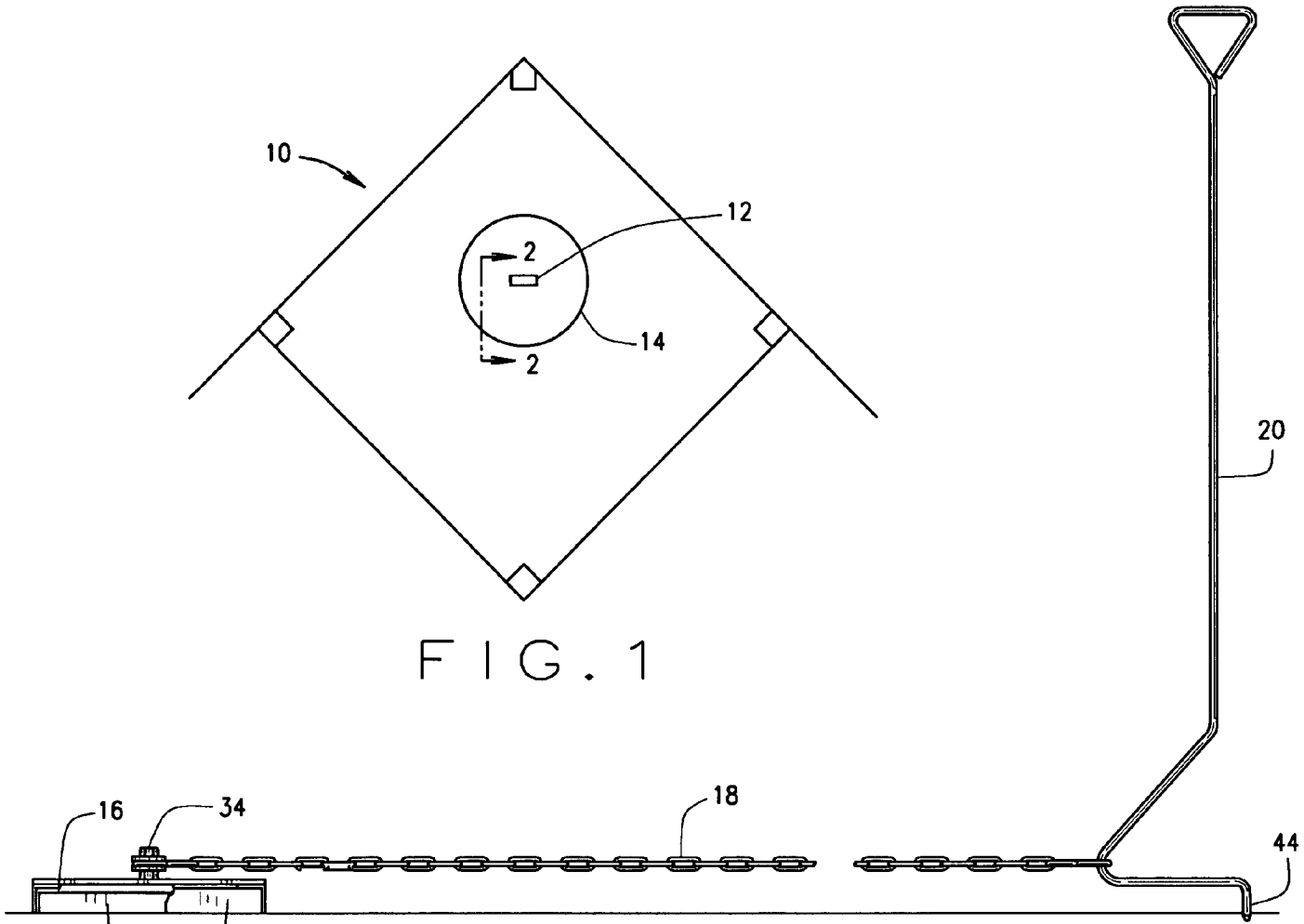
FIG. 1 is a top plan schematic view of a softball diamond, showing a pitcher's circle.
FIG. 2 is a side elevational view taken along lines 2-2 of FIG. 1 showing an embodiment of the invention with an end portion of the frame partially broken away.

A preferred embodiment of the invention will now be described with reference to the drawing figures, in which like reference numerals refer to like parts throughout. FIG. 1 schematically shows a softball playing field diamond 10 which can be on dirt, on a hard surface such as asphalt, or indoors. It features pitcher's plate 12 positioned at the appropriate location. Pitcher's circle 14 surrounds plate 12 and has a specific diameter as prescribed by relevant game regulations. Softball regulations prescribe a diameter of 16 feet. The present invention is designed for measuring out pitcher's circle 14 as further described below.

Figure 3:
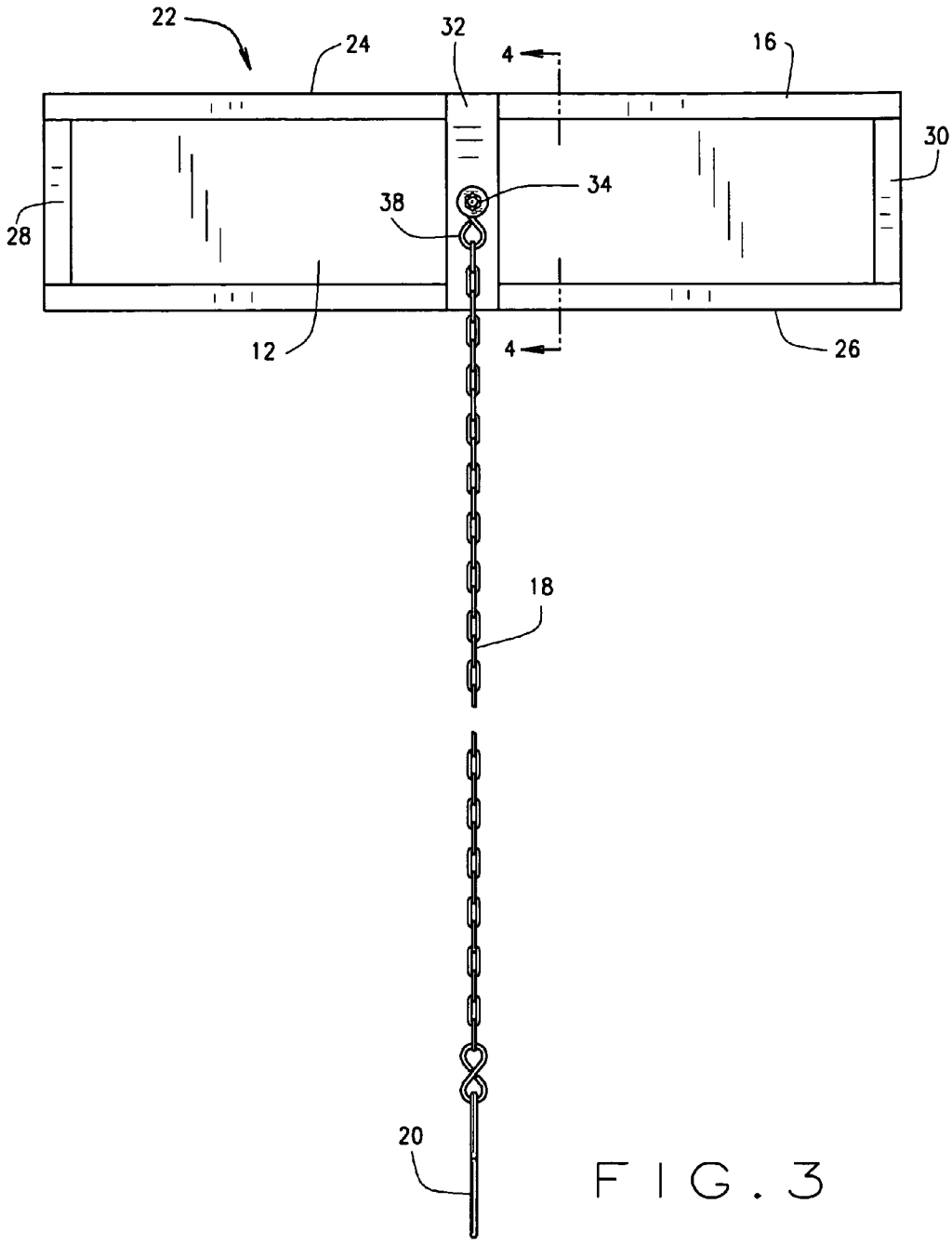
FIG. 3 is a top plan view of the invention.
Figure 4:
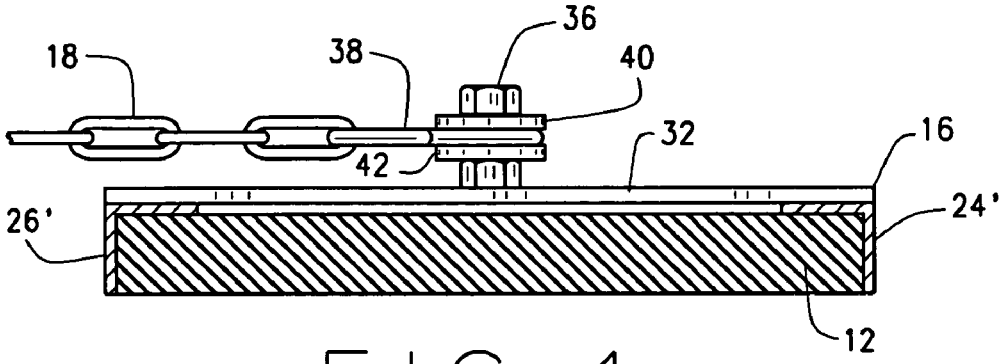
FIG. 4 is a cross-sectional view in side elevation taken along lines 4-4 of FIG. 3.
Figure 6:
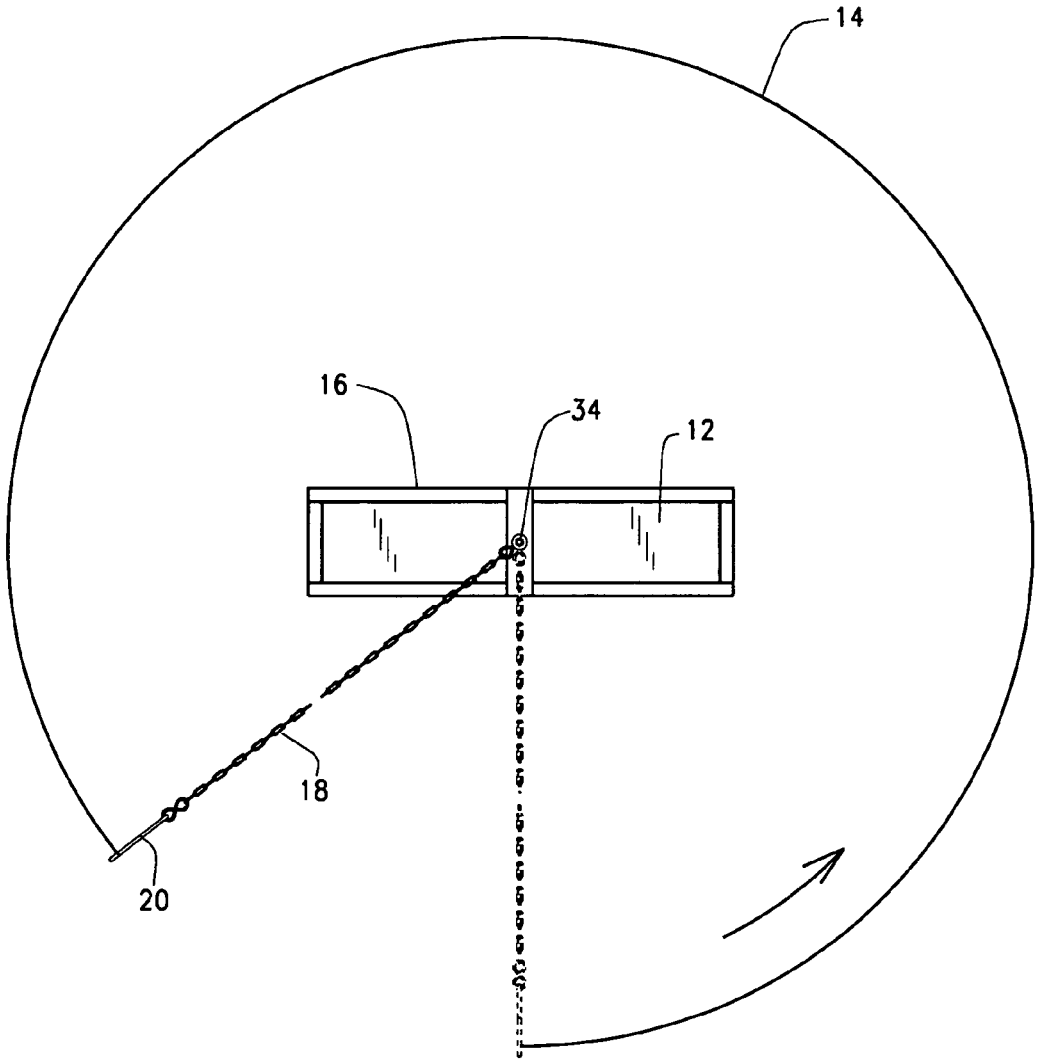
FIG. 6 is a top plan view showing a circle being drawn about a pitcher's plate using an embodiment of the invention.

The measuring device of the present invention is generally shown in FIG. 2 and comprises housing 16, measuring line 18 and guide rod 20. Housing 16 is adapted to fit and be retained over pitcher's plate 12. The dimension of a pitcher's plate is standard throughout the game of softball, being two feet long by six inches wide. Housing 16 may simply be comprised of a frame structure 22 having longitudinal members 24 and 26, end cross braces 28 and 30, and central cross brace 32 as shown in FIG. 3. Frame structure 22 may be made of metal, wood, plastic or other appropriate material. Housing 16 is most simply comprised of these minimal frame structure elements for light weight, but a top web (not shown) may also be provided if desired. Longitudinal members 24 and 26 and end cross braces 28 and 30 of housing 16 are formed with depending flanges 24', 26', 28' and 30', respectively, for engagement with the edges of pitcher's plate 12 as shown in FIG. 4. This arrangement enables housing 16 to be firmly held in place over pitcher's plate 12 as the measuring line is horizontally extended and walked out over an arc comprising the circle as shown in FIG. 6. The flanges prevent the housing from being disengaged from the plate.

A centering axis member 34 is provided on housing 16 at the center point of central cross brace 32 as shown in FIG. 3. Centering axis member 34 provides a swiveling base connection for measuring line 18. As shown in FIG. 4, a bolt and nut combination 36 may be used as the centering axis member 34. It may be welded or otherwise fixed in place, or a hole may be drilled in the top of housing 16 for receiving a long-bodied bolt or screw oriented with its threads rising up from the housing. A threaded arrangement as shown in FIG. 4 enables easy assembly of the connection point for measuring line 18. Measuring line 18 may comprise a chain, rope, cable or other flexible member. An S-hook 38 is provided on the end of measuring line 18 for connection to bolt 36. The opening of S-hook 38 permits unimpeded rotation of measuring line 18 about centering axis member 34. Washers 40 and 42 are placed on either side of S-hook 38 on bolt 36 to help retain the line on the bolt.

Measuring line 18 is connected to guide rod 20 such that the bottom end 44 represents the radius of the circle to be drawn. For example, if the radius distance measured from centering axis member 34 should be eight feet (for a total diameter of 16 feet for the pitcher's circle), and S-hooks or other connection devices are used, the measuring line may be a few inches short of eight feet to accommodate the extra length of the connection devices, as shown in FIG. 3. When the measuring line 18 is prepared, the lengths of the connection devices, if any, are subtracted from the length of the chain or rope comprising the measuring line so the sum total of measuring line, connectors and guide rod represents the actual radius distance of the pitcher's circle marked off from the pitcher's plate.

Figure 5:
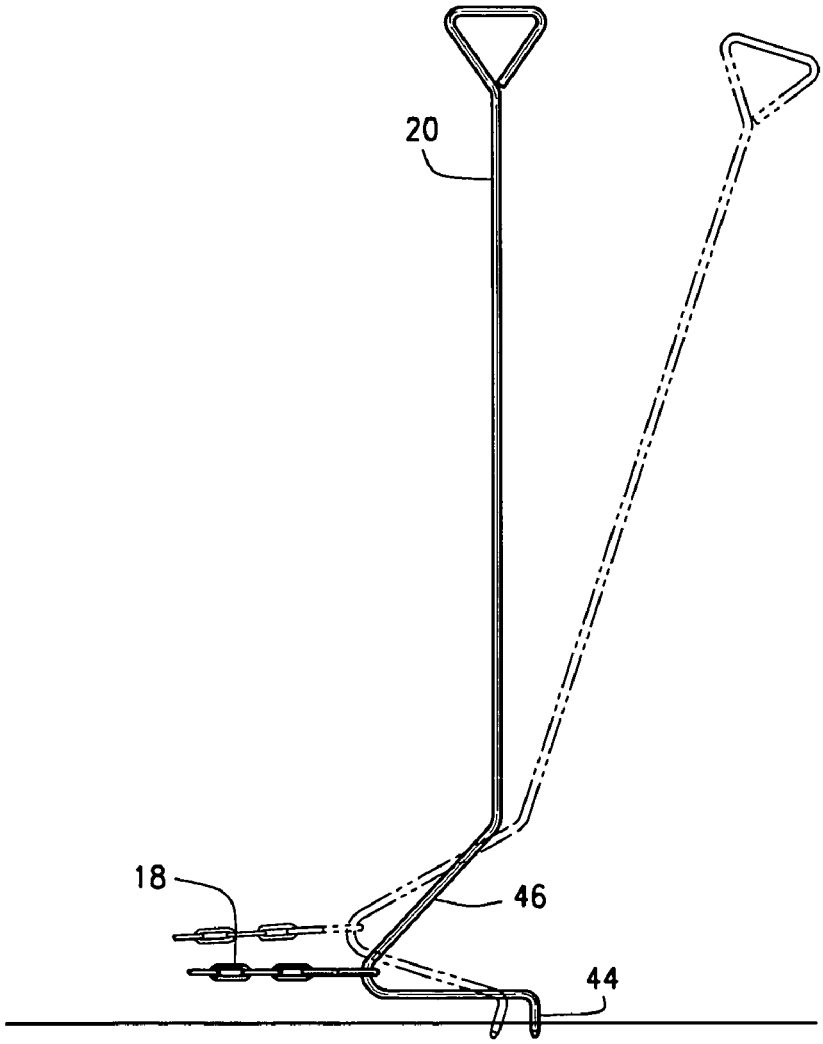
FIG. 5 is a side elevational and phantom view of the guide rod of an embodiment of the invention.

Even if the length of measuring line 18 is carefully prepared, it is nonetheless possible to obtain an inaccurate radial length if the guide rod is not held at a proper vertical orientation, as the phantom drawing in FIG. 5 suggests. It is very easy for the person drawing the circle to get careless in dragging the guide rod over the circle's path, whereby a straight rod can be inadvertently tilted away from true vertical. To minimize such an occurrence, guide rod 20 may be provided with a leveling member comprising a lower arm 46 that extends laterally from the guide rod. Lower arm 46 is disposed at a 90° angle from guide rod 20, and has a lower edge that is adapted to lie flush with the surface on which the pitcher's circle is drawn. By placing lower arm 46 flush with the ground while walking out the circle, guide rod 20 can be maintained at 90° from horizontal, which is true vertical, thereby preventing tilting and inaccurately measured radial distances. Lower arm 46 may be formed integrally with guide rod 20 as shown in FIG. 5 by configuring an offset shape in the rod. Measuring line 18 may be connected directly to lower arm 46, providing the length of lower arm 46 is taken into account when calculating the length of measuring line needed to make up the actual radial distance for the pitcher's circle.

Although an example of the pitcher's circle measuring device is shown, it will be appreciated that other embodiments can be constructed. From the above description of preferred embodiments of the invention, those skilled in the art will perceive improvements, changes and modifications. Such improvements, changes and modifications within the skill of the art are intended to be covered by the appended claims.

The many features and advantages of the invention are apparent from the detailed specification, and thus, it is intended by the appended claims to cover all such features and advantages of the invention which fall within the true spirit and scope of the invention. Further, since numerous modifications and variations will readily occur to those skilled in the art, it is not desired to limit the invention to the exact construction and operation illustrated and described, and accordingly, all suitable modifications and equivalents may be resorted to, falling within the scope of the invention.

What is claimed is:

1. An apparatus for measuring a circular line representing a pitcher's circle around a pitcher's plate for softball, said apparatus comprising:

a) a frame member, b) a centering axis member, c) a flexible measuring line having a fixed, predetermined length, and d) a guide rod, said frame member having a dimension approximating a standard dimension of said pitcher's plate, said frame member being adapted to be fit over and engage said pitcher's plate in a fixed relationship, said frame member forming downwardly depending flange edges adapted to engage outer side edges of said pitcher's plate, said centering axis member being disposed in a center of said frame member, said measuring line being connected to said centering axis member, said guide rod being connected to a distal end of said measuring line such that said guide rod represents a radius distance point of said pitcher's circle from said pitcher's plate, said guide rod being adapted to be moved in an arc defined by said radial distance about said centering axis member in a horizontal plane about said pitcher's plate over an area representing said pitcher's circle.

2. The apparatus of claim 1 in which said measuring line is adapted to rotate about its connection with said centering axis member.

3. The apparatus of claim 1 in which said guide rod is adapted to make a mark in a surface over said area representing said pitcher's circle.

4. The apparatus of claim 1 in which said guide rod further comprises a leveling member, said leveling member adapted to enable a user to maintain said guide rod at a 90° angle with respect to a surface over which it is moved.

5. The apparatus of claim 4 in which said leveling member comprises a laterally extending arm member, said arm member being disposed at a 90° angle with respect to said guide rod, said arm member being adapted to engage said surface along its length whereby said guide rod is maintained in a vertical orientation 90° with respect to said arm member.

6. The apparatus of claim 5 in which said guide rod forms said arm member at a lower end thereof.

7. The apparatus of claim 6 in which a tip end of said guide rod extends below said arm member, said tip end adapted to penetrate into a soft surface to the extent of said arm member to create a mark.

8. The apparatus of claim 6 in which said measuring line connects to said guide rod at said arm member.

9. An apparatus for measuring a circular line representing a pitcher's circle around a pitcher's plate for softball, said apparatus comprising:

a) a frame member, b) a centering axis member, c) a flexible measuring line having a fixed, predetermined length, and d) a guide rod, said frame member being adapted to be fixed in position over said pitcher's plate, said centering axis member being disposed on said frame member such that said centering axis member aligns over a center point of said pitcher's plate when said frame member is placed in position over said pitcher's plate, said measuring line being connected to said centering axis member, said guide rod being connected to a distal end of said measuring line such that said guide rod represents a radius distance point of said pitcher's circle from said pitcher's plate, said guide rod being adapted to be moved in an arc defined by said radial distance about said centering axis member in a horizontal plane about said pitcher's plate over an area representing said pitcher's circle;

said guide rod further comprises a leveling member, said leveling member adapted to enable a user to maintain said guide rod at a 90° angle with respect to a surface over which it is moved;

said leveling member comprises a laterally extending arm member, said arm member being disposed at a 90° angle with respect to said guide rod, said arm member being adapted to engage said surface along its length whereby said guide rod is maintained in a vertical orientation 90° with respect to said arm member.

10. The apparatus of claim 9 in which said guide rod forms said arm member at a lower end thereof, said measuring line connecting to said guide rod at said arm member.

11. An apparatus for measuring a circular line representing a pitcher's circle around a pitcher's plate for softball, said apparatus comprising:

a) a frame member, b) a centering axis member, c) a flexible measuring line having a fixed, predetermined length, and d) a guide rod, said frame member being adapted to be fixed in position over said pitcher's plate, said centering axis member being disposed on said frame member such that said centering axis member aligns over a center point of said pitcher's plate when said frame member is placed in position over said pitcher's plate, said measuring line being connected to said centering axis member, said guide rod being connected to a distal end of said measuring line such that said guide rod represents a radius distance point of said pitcher's circle from said pitcher's plate, said guide rod being adapted to be moved in an arc defined by said radial distance about said centering axis member in a horizontal plane about said pitcher's plate over an area representing said pitcher's circle, said guide rod further comprising a leveling member, said leveling member adapted to enable a user to maintain said guide rod at a 90° angle with respect to a surface over which it is moved;

said measuring line is adapted to rotate about its connection with said centering axis member;

said leveling member comprises a laterally extending arm member, said arm member being disposed at a 90° angle with respect to said guide rod, said arm member being adapted to engage said surface along its length whereby said guide rod is maintained in a vertical orientation 90° with respect to said arm member.

12. The apparatus of claim 11 in which said guide rod forms said arm member at a lower end thereof, said measuring line connecting to said guide rod at said arm member.

* * * * *